US009306313B2

(12) United States Patent
Heggemann et al.

(10) Patent No.: US 9,306,313 B2
(45) Date of Patent: Apr. 5, 2016

(54) ADAPTER ARRANGEMENT

(71) Applicant: Weidmueller Interface GmbH & Co. KG, Detmold (DE)

(72) Inventors: Christian Heggemann, Detmold (DE); Hans Schlingmann, Horn-Bad Meinberg (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 14/106,924

(22) Filed: Dec. 16, 2013

(65) Prior Publication Data

US 2014/0179158 A1 Jun. 26, 2014

(30) Foreign Application Priority Data

Dec. 20, 2012 (DE) ..... 20 2012 104 999 U

(51) Int. Cl.

| | |
|---|---|
| ***H01R 13/74*** | (2006.01) |
| ***H01R 13/40*** | (2006.01) |
| ***H01R 13/514*** | (2006.01) |
| ***H01R 13/52*** | (2006.01) |
| ***H01R 13/629*** | (2006.01) |

(52) U.S. Cl.

CPC ..... *H01R 13/514* (2013.01); *H01R 13/40* (2013.01); *H01R 13/5202* (2013.01); *H01R 13/62933* (2013.01); *H01R 13/74* (2013.01)

(58) Field of Classification Search

USPC ..... 439/556, 559, 587, 589, 271, 272, 439/278–283, 286, 289, 300, 548, 544, 564, 439/76.1, 594, 578, 620.31, 370; 174/50.52

See application file for complete search history.

(56) References Cited

U.S. PATENT DOCUMENTS

| | | | | |
|---|---|---|---|---|
| 5,338,211 | A * | 8/1994 | Kodama et al. | 439/135 |
| 5,511,990 | A * | 4/1996 | Klemen | 439/559 |
| 6,022,237 | A * | 2/2000 | Esh | 439/348 |
| 6,669,506 | B2 * | 12/2003 | Newton | 439/559 |
| 7,355,130 | B2 * | 4/2008 | Holman et al. | 174/658 |
| 7,781,684 | B2 * | 8/2010 | Stuckmann et al. | 174/650 |
| 7,914,298 | B2 * | 3/2011 | Lauermann et al. | 439/76.1 |
| 2008/0050935 | A1 | 2/2008 | Tsuji | |

FOREIGN PATENT DOCUMENTS

| | | |
|---|---|---|
| DE | 200 05 860 U1 | 7/2000 |
| DE | 698 14 299 T2 | 1/2004 |
| DE | 10 2005 054 601 A1 | 5/2007 |

* cited by examiner

*Primary Examiner* — Abdullah Riyami
*Assistant Examiner* — Harshad Patel
(74) *Attorney, Agent, or Firm* — Lawrence E. Laubscher, Sr.; Lawrence E. Laubscher, Jr.; Robert D. Spendlove

(57) ABSTRACT

A first adapter arrangement includes a housing having a sealing end supporting the housing in a vertical wall opening of a casing containing an electronics device, and a connecting end extending externally of the casing for connection with the housing of a companion adapter arrangement. A pair of resilient generally-annular longitudinally-spaced seal members are mounted concentrically about the adapter housing sealing portion for sealing the space between the adapter housing outer surface and the adjacent surface of the casing wall opening. An electrical connector mounted in a through passage contained in the adapter housing includes a conductor contact end connected with the conductors of the electrical device, and a connector contact end adapted for connection with the corresponding contacts of a companion second adapter arrangement. A fastening device serves to connect together the adjacent ends of the adapter housings of the first and second arrangements.

4 Claims, 7 Drawing Sheets

Fig. 4c
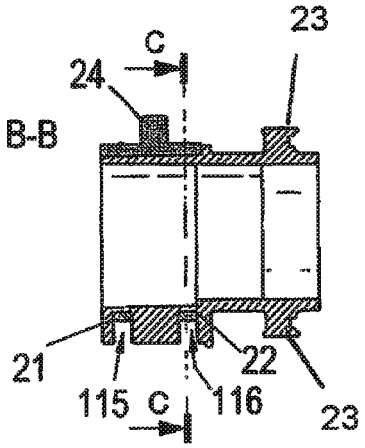
Fig. 4d
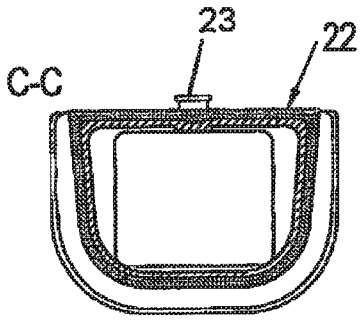
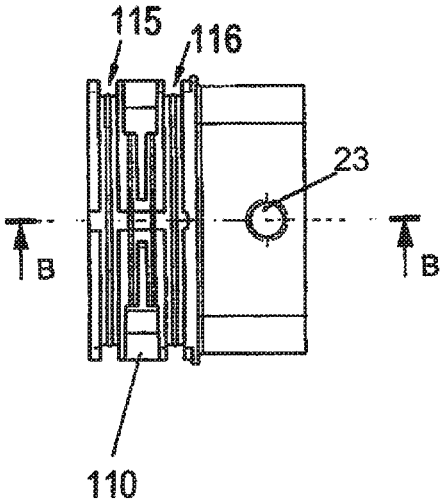
Fig. 4b
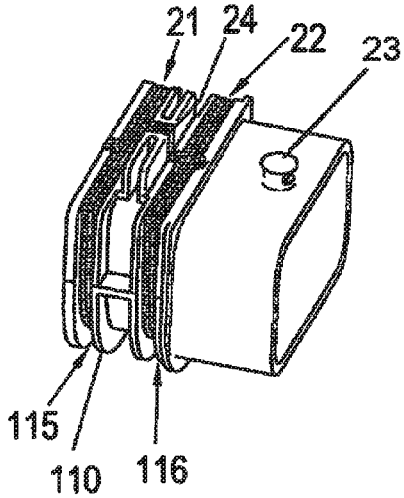
Fig. 4a

ADAPTER ARRANGEMENT

REFERENCE TO RELATED APPLICATIONS

This application is based on and claims priority of the German application No. DE 20 2012 104 999.6 filed Dec. 20, 2012.

FIELD OF THE INVENTION

A first adapter arrangement includes a housing having a sealing end supporting the housing in a vertical wall opening of a casing containing an electronics device, and a connecting end extending externally of the casing for connection with the housing of a companion adapter arrangement. A pair of resilient generally-annular longitudinally-spaced seal members are mounted concentrically about the adapter housing sealing portion for sealing the space between the adapter housing outer surface and the adjacent surface of the casing wall opening. An electrical connector mounted in a through passage contained in the adapter housing, and a fastening arrangement serves to connect together the adjacent ends of the adapter housings of the first and second arrangements.

DESCRIPTION OF RELATED ART

Electronics device frequently must be arranged in spaces exposed to dust, moisture, EMV and other contaminants. Such spaces are outdoor installations, production lines and/or the surroundings of power installations, for example. The present invention was developed to provide an electronics assembly which allows multiple electronics housings to be flexibly connected in series, and ensures very good dust, moisture and contaminant protection.

SUMMARY OF THE INVENTION

Accordingly, a primary object of the invention is to provide a first adapter arrangement including a housing having a sealing end supporting the housing in a vertical wall opening of a casing containing an electronics device, and a connecting end extending externally of the casing for connection with the housing of a companion adapter arrangement, a pair of resilient generally-annular longitudinally-spaced seal members being mounted concentrically about the adapter housing sealing portion for sealing the space between the adapter housing outer surface and the adjacent surface of the casing wall opening. An electrical connector mounted in a through passage contained in the adapter housing includes a conductor contact end connected with the conductors of the electrical device, and a connector contact end adapted for connection with the corresponding contacts of a companion second adapter arrangement.

According to a further object, a fastening assembly is provided that connects together the adjacent ends of the adapter housings of the first and second arrangements.

A further object is to provide an adapter arrangement for connecting electrical lines to an electronics housing. The adapter system comprises an adapter housing, which has an interior space and a respective opening on two mutually opposing end faces, and a plug connector, which is arranged in the interior space of the adapter housing and can be accessed through the respective openings. It is preferable that the adapter housing comprises a connecting region having an attachment means for attaching a corresponding second adapter system, and a sealing region having two sealing rings for the sealing arrangement in the electronics housing. The adapter system can be used to connect a cable and/or a series connected electronics housings.

So as to ensure the necessary dust, moisture and/or EMV protection, the sealing rings are preferably arranged behind one another in an extension direction of the adapter housing. Preferably one or both sealing rings are either inserted into the adapter housing so that they can be flexibly exchanged, or they are embedded therein in foam so that they are connected in a captive manner to the adapter housing. In a preferred embodiment, they are produced from differing materials. It is preferred that one of the sealing rings is designed as an EMV protection, wherein the other of the two sealing rings is designed as a dust and moisture protection, or that both sealing rings are designed as dust and moisture protections. Arranging the two sealing rings behind one another not only has the advantage of flexible adaptability to dust, moisture and/or EMV requirements, but also ensures better protection in this regard in a higher protection category.

Preferably a projection and a bracket are provided as the attachment means. It is preferred that the bracket can be rotated about a rotational axis, so that it can be rotated from a basic state into an attachment state. The bracket of a first adapter system can thus be locked to the ridge of a second adapter system.

The plug connector preferably has a connecting side and a contact side, wherein the connecting side can be accessed from the second opening of the adapter housing, and wherein the contact side can be accessed from the first opening of the adapter housing. It is preferable for this purpose that the connecting side is designed as a plug and/or socket. A second plug connector having a complimentary design can thus be connected to the plug connector, and in particular be inserted therein. Attachment means for electrical lines are preferably provided on the contact side, such as cable lugs, so that the electrical lines can be quickly connected.

Moreover, the plug connector is preferably detachably arranged in the adapter housing, in particular clamped, latched or screwed. The plug connector thus can be exchanged or replaced by a differently designed plug connector.

So as to ensure sealing also in the interior space of the adapter housing, the plug connector likewise preferably comprises a first interior space seal, whereby it is arranged in a sealed relation in the adapter housing. In addition or as an alternative, the adapter housing preferably has a second interior space seal in the interior space. In this way dust, moisture and/or EMV cannot penetrate into an electronics housing, not even through the interior space of the adapter housing.

Another object is to provide an adapter assembly comprising two such adapter systems. It is preferable for the adapter systems to be designed so as to complement to each other. The adapter systems are preferably plugged together or into each other. It is particularly preferred for the first adapter system to comprise a first attachment means and a first plug connector, and for the second adapter system to comprise a second attachment means and a second plug connector. It is still more particularly preferred for the first attachment means to be designed to complement the second attachment means, and for the first plug connector to be designed to complement the second plug connector. The adapter systems can thus be arranged behind one another and attached to one another.

The first adapter system preferably comprises a projection as the first part of the attachment means, wherein the second adapter system likewise preferably comprises a bracket as the second part of the attachment means. The bracket can preferably be pivoted from a basic released state about a pivot axis into a locked attachment state. In the locked attachment state, the bracket preferably engages the projection when the adapter systems are plugged into each other, so that the two adapter systems are detachably attached to each other.

Still another object is to provide an electronics assembly comprising an electronics housing and such an adapter system or such an adapter assembly. An electronic system is preferably arranged in the electronics housing. It is likewise preferable if the electronics housing can be accessed from a cover side. The housing can preferably be closed by a cover or a cover component. The sealing rings are preferably designed to have a closed circumference.

It is preferable for the adapter assembly to be insertable into a receiving portion of the electronics housing when the electronics housing is open, so that the sealing region of the adapter housing is arranged in the receiving portion. The insertion from the cover side is possible in a very simple and quick manner.

The sealing rings are particularly preferably seated in a sealed manner against the closed electronics housing and against the cover or cover component when the adapter assembly is inserted into the receiving portion. The closed electronics assembly is thus sealed very well against dust, moisture and/or EMV.

In an electronics assembly comprising an adapter assembly, it is preferable for both adapter systems to be inserted into a respective receiving portion of an electronics housing so that the electronics housings are connected in series.

BRIEF DESCRIPTION OF THE DRAWINGS

Other objects and advantages of the invention will become apparent from a study of the following specification, when viewed in the light of the accompanying drawing, in which:

FIG. 4*a* is a perspective view of a modification of the adapter housing of FIG. 1*a;*

FIG. 4*b* is a top view of the apparatus of FIG. 4*a;*

FIG. 4*c* is a sectional view taken along line B-B of FIG. 4*b*; and

FIG. 4*d* is a sectional view taken along line C-C of FIG. 4*a*.

DETAILED DESCRIPTION OF THE INVENTION

Figure 1A:
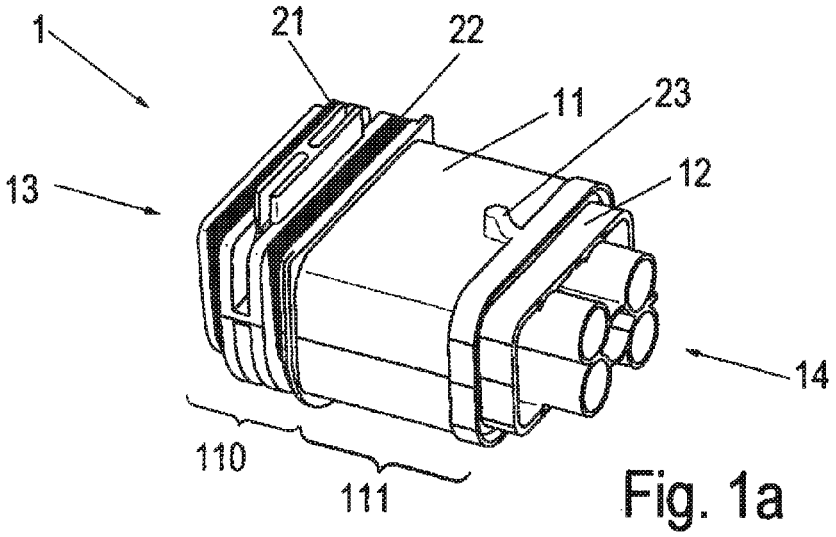
FIG. 1 is a perspective view of a first adapter arrangement.
FIG. 1*b* is a corresponding view of a companion adapter arrangement.
FIGS. 1*c* and 1*d* are exploded views of the devices of FIGS. 1*a* and 1*b*, respectively.
Figure 1B:
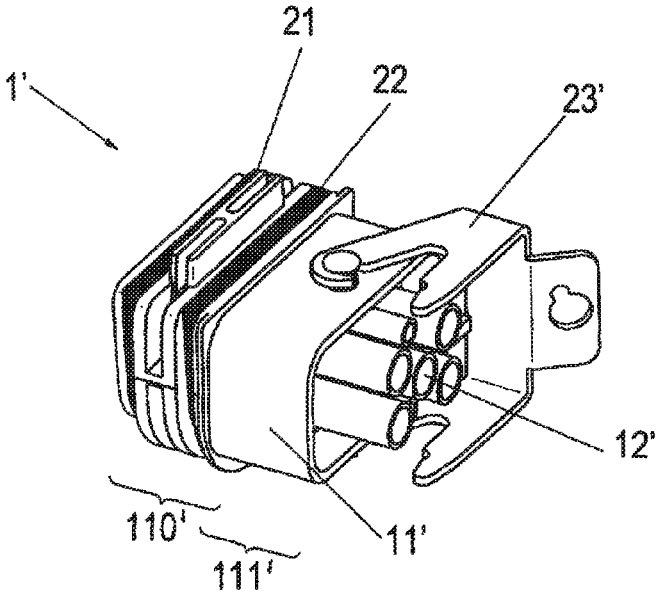
Figure 1C:
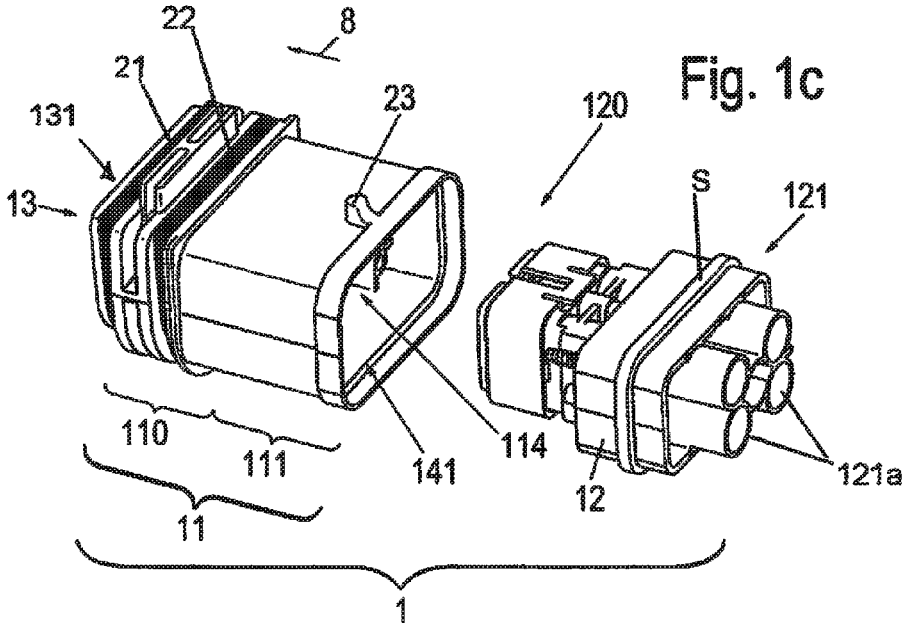
Figure 2A:
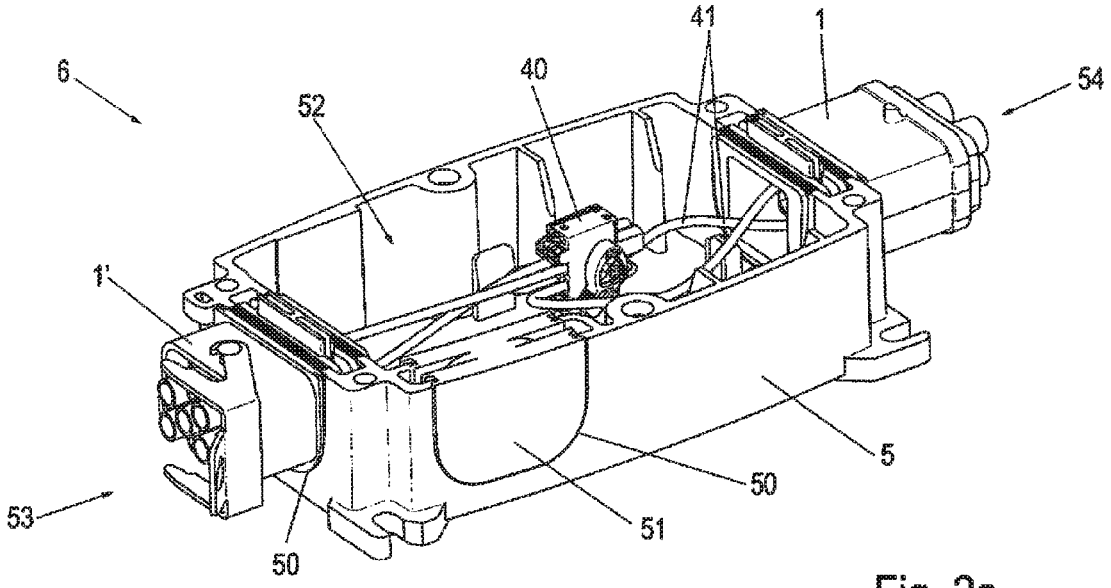
FIGS. 2*a*-2*c* are left end perspective, right end perspective, and exploded views, respectively, of an electronics device assembly including the adapter arrangements of FIGS. 1*a* and 1*b;*

Referring first more particularly to FIGS. 1*a* and 1*c*, a first adapter arrangement 1 includes a hollow adapter housing 11 having first and second ends 13 and 14, said housing containing a through passage 114 having first and second end openings 131 and 141. At its first end, the adapter housing 11 has a sealing region 110 provided with two generally-annular concentrically-mounted longitudinally spaced resilient seal members 21 and 22, and at its second end the adapter housing has a connecting region 111 provided with vertical upper and lower projections 23 that define a first fastening part. Removably arranged in the through passage 141 is a socket connector 12 having a conductor contact end 120 having plurality of conductor contacts connected with the conductors 41 of an electrical device 40 (FIG. 2*a*), and a connection contact end 121 having a plurality of female socket contacts 121*a*.

Figure 1D:
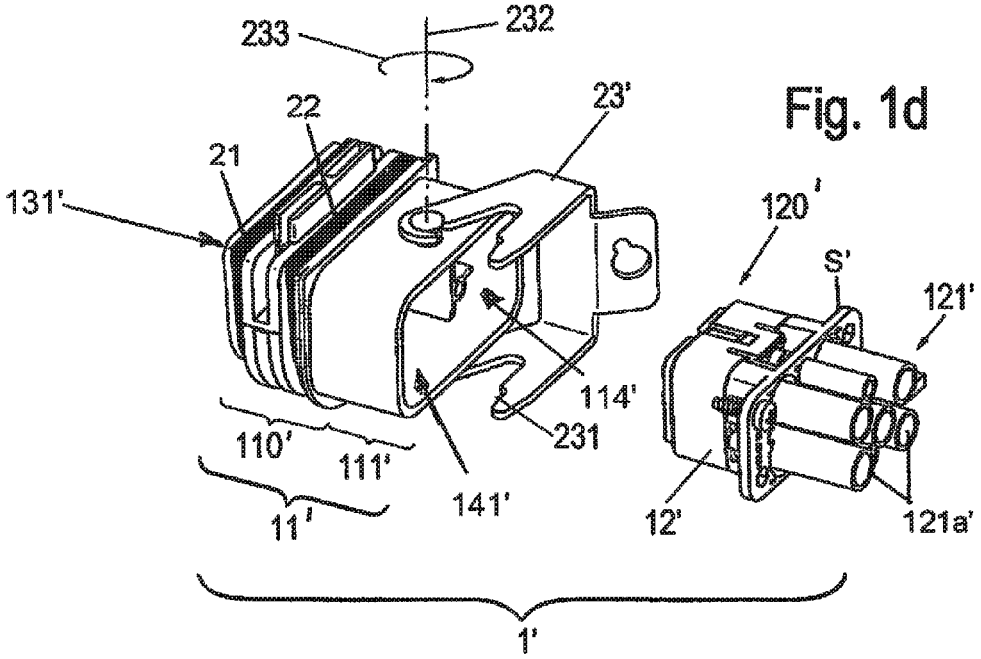

Similarly, the companion second adapter arrangement 1' of FIGS. 1*b* and 1*d* includes an adapter housing 11' having a first end with a sealing region 110' provided with two longitudinally-spaced seal members 21 and 22, and a second end provided with a connection region 111' provided with a locking bracket member 23' that defines a second locking part. The housing 11' contains the through passage 114' that extends from the first housing end 131' to the second housing end 141'. The seal members 21, 22 are provided behind one another in an extension direction 8 of the adapter housing 11'. They can be produced from the same material or from differing materials. Moreover, they can be inserted into the sealing region 110, or be integrally embedded therein in foam.

The locking bracket 23' is connected with the adapter housing 11' for pivotal movement about the vertical pivot axis 232 in the direction 233 from the illustrated released position and toward a locked position (FIG. 3) in which the upper and lower locking projections 23 extend within the upper and lower locking slots 231 contained in the locking bracket 23'. Removably mounted in the through passage contained in the second adapter body 11' is an electrical plug connector 12' having a conductor contact end 120' provided with a plurality of conductor contacts connected with the conductors of the 41 of the electrical device 40 (FIG. 2*a*), and a connection contact end 121' provided with a plurality of male pin contacts 121*a*'. The connector devices are provided with resilient seal members S and S' that engage the adjacent surfaces of the associated adapter through passages 114 and 114', respectively. Each socket and plug connector 12, 12' is detachably arranged within the associated adapter housing 11, 11'. For example, it is clamped to, engaged by latch means on, or screwed into the associated adapter housing. The conductor contacts of the connectors are connected with the associated conductors 41 of the electronics device 40 by soldering, screw means, or resilient means.

Figure 2B:
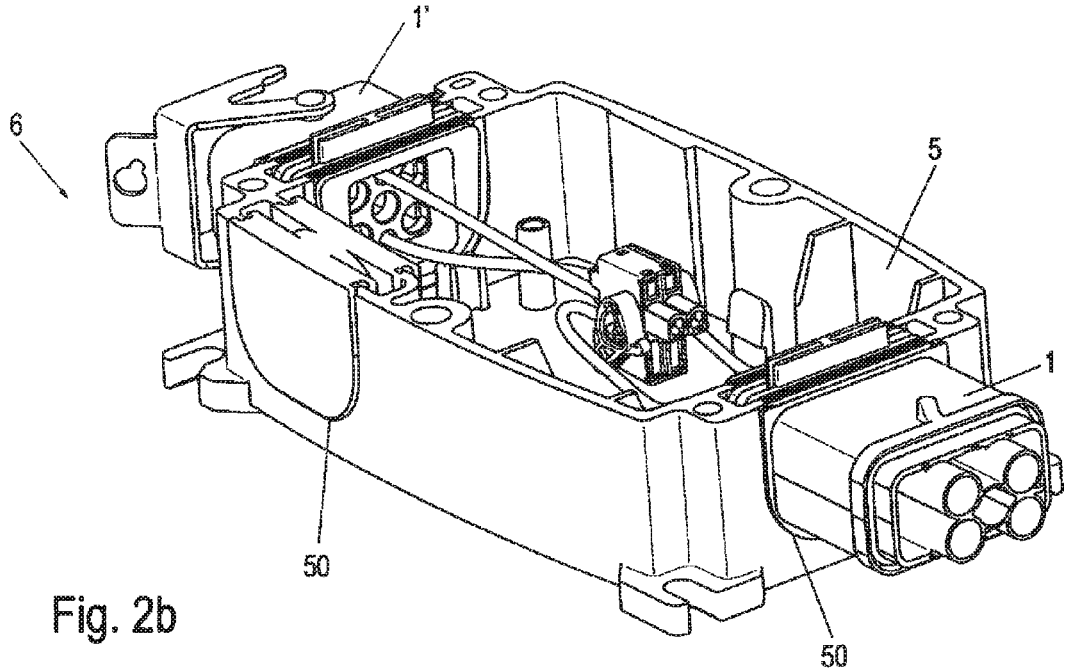
Figure 2C:
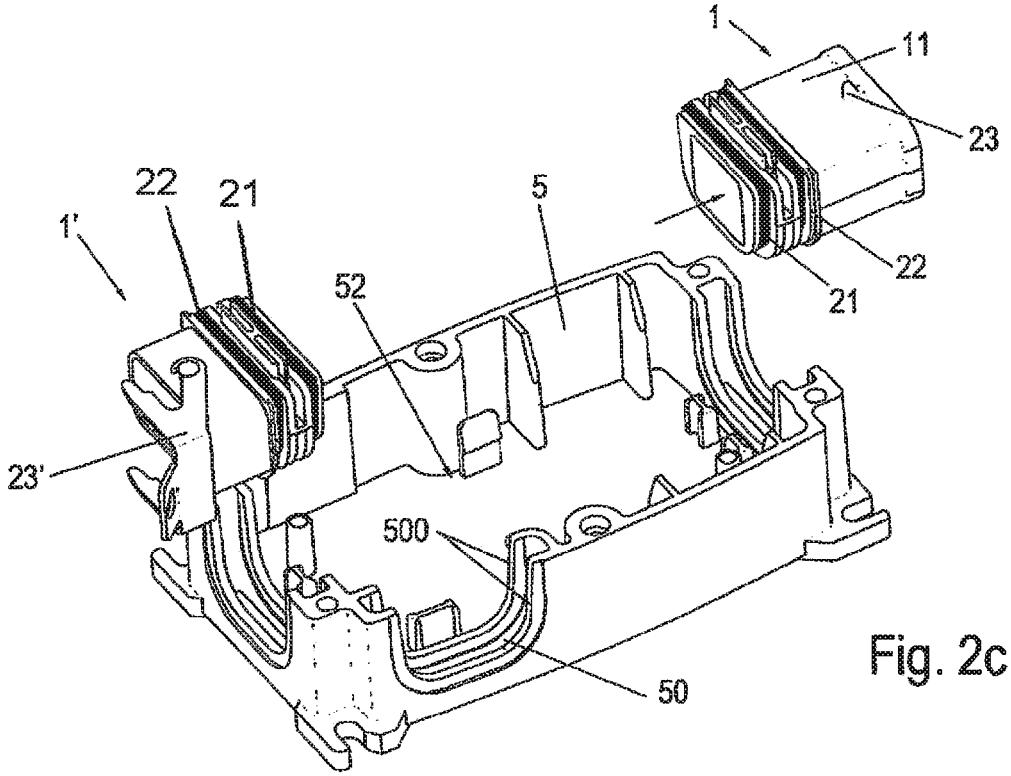

Referring to FIG. 2, the electronics assembly 6 includes a rectangular open-topped electronics casing 5 provided with first and second adapter arrangements 1, 1' arranged in openings 50 contained in opposing casing end wall 53 and 54, respectively. The adapter arrangements 1, 1' are interchangeably inserted into the receiving openings 50. In addition, a side wall receiving opening 50 is provided, into which a receiving portion a dummy closure member 51 is inserted instead of an adapter system 1, 1'.

Figure 3:
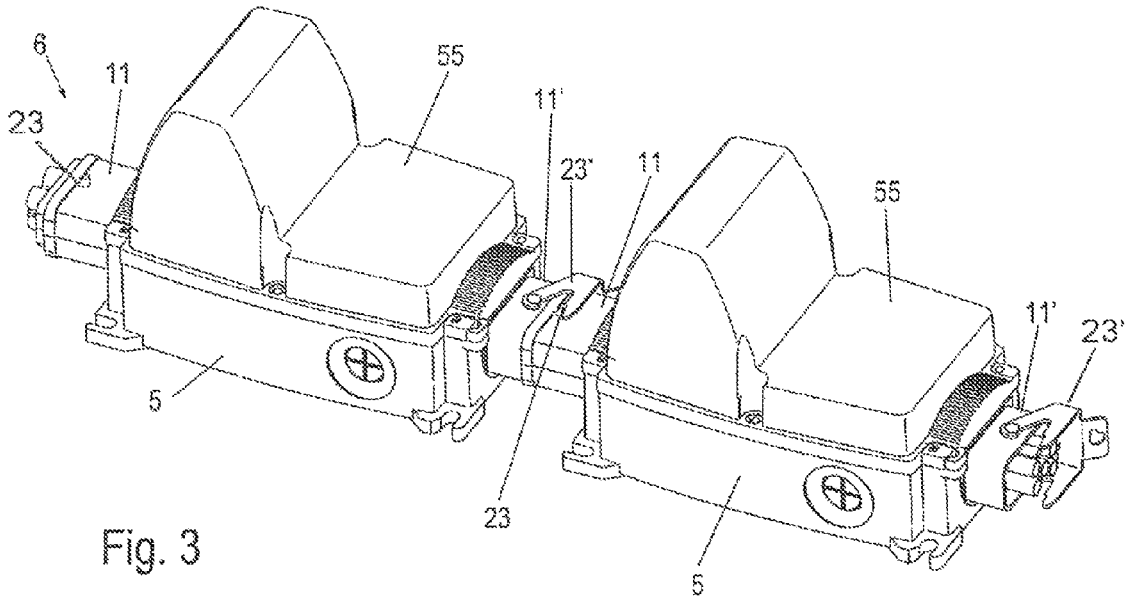
FIG. 3 is a perspective view of two of the electronics devices of FIGS. 2*a*-2*c* in a covered, assembled condition.

The electronics casing 5 is open-topped so that it can be accessed from above. The casing chamber may be closed by a cover member 55, as shown in FIG. 3. When the chamber within electronics casing 5 is open, the adapter assemblies 1, 1' can be inserted into a respective receiving openings 50 of the electronics casing 5 from the upper side so that the respective sealing region of the adapter housing is arranged in the receiving portion. So as to prevent dust, moisture and/or EMC from penetrating the space between the adapter housing and the adjacent wall opening surface, the electronics casing 5 is designed to be double-walled (FIG. 2*c*) in the region of the receiving openings 50, wherein each of the sealing rings 21, 22 arranged in the sealing region 120 ensures sealing on one of the two casing ribs 500. When the electronics casing 5 is closed, the sealing rings 21, 22 thus are seated in compressed against a respective casing rib 500.

An electrical device 40 is arranged in the housing interior space 52 of the electronics casing 5. The electrical device 40 is connected via electrical lines 41 to electrical contacts (not shown) on the contact side 120', 120 of the plug and socket connectors 12', 12, which can each be accessed from the corresponding first end opening 131', 131.

In FIG. 3, two electronics assemblies 6 according to FIG. 2 are connected in series in end-to-end relation. Two mutually complementary adapter systems land 1' are plugged together to form an adapter assembly. In this adapter assembly, the female socket connector 12 of the first adapter system 1 and the male plug connector 12' of the second adapter system 1 are thus designed to complement each other so that they can be plugged together. In addition, the first attachment means 23 of the first adapter system 1, which is designed as a projection, and the attachment means 23' of the second adapter system 1', which is designed as a bracket, serve to complement each other. Accordingly, the bracket is shown here in the attachment state, in which it is locked to the projection.

In this illustration, the electronics casings 5 are each closed by a cover component 55. Because of the two sealing rings 21, 22 provided in the sealing region 110 of the adapter system 1, 1', the interior space 52 of the electronics housing 5, or an electronic system 40 arranged there, is protected well from the penetration of dust, moisture and/or EMV.

According to FIGS. 4*a-d*, the sealing rings 21, 22 of an alternative adapter housing or plug connector housing system (which here is shown without internal plug connectors) are integrally connected together as one piece to each other via a bridging connection 24, which here is oriented transversely relative to the planes thereof and which engages in a groove for fixation. It is also possible to use a two-component production method so as to configure the sealing rings differently from each other. The sealing rings can be inserted into or molded onto the housing.

In all of the exemplary embodiments, the sealing rings 21, 22 can be inserted or molded into peripheral grooves 115, 116 that are open to the outside in the sealing region 110. In order to improve the sealing action, they can each also be provided with a small radial outer circumferential rib.

While in accordance with the provisions of the Patent Statutes the preferred forms and embodiments of the invention have been illustrated and described, it will be apparent to those skilled in the art that changes may be made without deviating from the invention described above.

What is claimed is:

1. An adapter arrangement for mounting an electrical connector in a sealed electronics casing, comprising:

(a) a rectangular open-topped first electronics casing (5) having a horizontal bottom wall, and two pairs of vertical side and end walls that cooperate with said bottom wall to define a chamber (52), (1) at least two of said vertical side and end walls having top edge portions containing access openings (50);

(2) each of said access openings including a wall surface provided with two continuous longitudinally-spaced ribs (500) that extend the entire surface of said opening;

(b) an electrical device (40) arranged in said electronics casing chamber, said electrical device including a plurality of electrical conductors (41);

(c) a pair of adapter housings (11, 11') having sealing ends (13, 13') inserted within said wall openings, respectively, and connecting ends (14, 14') extending outwardly from said first electronics casing, said adapter housings containing longitudinal through passages (114, 114');

(d) an adapter sealing arrangement for sealing the space between each adapter housing and the associated electronics casing opening, including a pair of longitudinally-spaced resilient continuous annular first seal members (21, 22) mounted concentrically about said adapter housing sealing end for sealing engagement with corresponding rib surfaces on the associated electronics casing access opening, respectively;

(e) a pair of electrical connectors (12, 12') mounted in said adapter housing through passages, respectively, each of said electrical connectors including a connector body having a contact end (120, 120') including a plurality of internal conductor contacts connected with said electrical device conductors, and a connection end (121, 121') including a plurality of external conductor contacts (121*a*; 121*b*);

(f) a connector sealing arrangement for sealing the space between each connector body and the wall of the associated adapter through passage, comprising a second annular seal member (S, S') mounted concentrically about said connector body for sealing engagement with the adjacent wall surface of the associated adapter housing through passage;

(g) a cover member (55) seated on said electronics casing to close said electronics casing chamber, said cover member cooperating with said first seal members to close said access openings, thereby to protect the electronics housing chamber from dust and moisture; and (h) a fastening arrangement (23, 23') operable to fasten said adapter housing connecting end with the connecting end of a companion adapter housing.

2. The adapter arrangement as defined in claim 1, wherein the external connector contacts of one (1') of said electrical connectors (12') comprise male pin contacts (121*a'*), and the external connector contacts of the other one (1) of said electrical connectors (12) comprise female socket contacts (121*a*).

3. The adapter arrangement as defined in claim 2, and further including a second electronics casing having a second adapter arrangement adapted for engagement with a corresponding adapter arrangement of said first electronics casing, respectively; and further wherein said fastening means includes an external locking projection (23) on one of the adapter arrangements of said first electronics casing, and a pivotally mounted bracket (23') on the companion adapter arrangement of the second electronics casing, said bracket being pivotally displaceable between a released position spaced from said locking projection, and a locked position in which said locking projection extends in locking engagement within a locking recess (231) contained in said bracket.

4. An adapter arrangement for mounting an electrical connector in a sealed electronics casing, comprising:

(a) a rectangular open-topped first electronics casing (5) having a horizontal bottom wall, and two pairs of vertical side and end walls that cooperate with said bottom wall to define a chamber (52), (1) at least two of said vertical side and end walls having top edge portions containing access openings (50);

(2) each of said access openings including a wall surface provided with two continuous longitudinally-spaced ribs (500) that extend the entire surface of said opening;

(b) an electrical device (40) arranged in said electronics casing chamber, said electrical device including a plurality of electrical conductors (41);

(c) a pair of adapter housings (11, 11') having sealing ends (13, 13') inserted within said wall openings, respectively, and connecting ends (14, 14') extending outwardly from said first electronics casing, said adapter housings containing longitudinal through passages (114, 114');

(d) an adapter sealing arrangement for sealing the space between each adapter housing and the associated electronics casing opening, including a pair of longitudinally-spaced resilient continuous annular first seal members (21, 22) mounted concentrically about said adapter housing sealing end for sealing engagement with corresponding rib surfaces on the associated electronics casing access opening, respectively;

(e) a pair of electrical connectors (12, 12') mounted in said adapter housing through passages, respectively, each of said electrical connectors including a connector body having a contact end (120, 120') including a plurality of internal conductor contacts connected with said electrical device conductors, and a connection end (121, 121') including a plurality of external conductor contacts (121*a*; 121*a'*);

(f) a connector sealing arrangement for sealing the space between each connector body and the wall of the associated adapter through passage, comprising a second annular seal member (S, S') mounted concentrically about said connector body for sealing engagement with the adjacent wall surface of the associated adapter housing through passage;

(g) a cover member (55) seated on said electronics casing to close said electronics casing chamber, said cover member cooperating with said first seal members to close said access openings, thereby to protect the electronics housing chamber from dust and moisture; and (h) a fastening arrangement (23, 23') operable to fasten said adapter housing connecting end with the connecting end of a companion adapter housing;

(i) said adapter sealing arrangement including at least one longitudinally-extending bridge portion (24) integrally connected between said first seal members.

* * * * *